United States Patent [19]

Cormier

[11] 4,096,716

[45] Jun. 27, 1978

[54] LOCK-LATCH SET

[76] Inventor: Paul S. Cormier, #2-520 Victoria St., New Westminster, B.C., Canada

[21] Appl. No.: 717,261

[22] Filed: Aug. 23, 1976

[51] Int. Cl.[2] ..... E05B 65/06

[52] U.S. Cl. ..... 70/139; 70/349; 70/392

[58] Field of Search ..... 70/135, 137, 139, 149, 70/348-350, 352, 353, 392, DIG. 52, 363, 364 A; 292/216

[56] References Cited

U.S. PATENT DOCUMENTS

| | | | |
|---|---|---|---|
| 13,722 | 10/1855 | Holmes et al. | 70/139 |
| 874,694 | 12/1907 | Miller | 70/349 X |
| 962,486 | 6/1910 | Ziron | 70/352 X |
| 1,515,611 | 11/1924 | O'Connor | 70/364 A X |
| 3,102,412 | 9/1963 | Christopher | 70/363 |
| 3,451,704 | 6/1969 | Cothron | 70/135 X |
| 3,653,238 | 4/1972 | Brugemann | 70/352 X |
| 3,890,813 | 6/1975 | Cothron | 70/139 X |
| 3,922,896 | 12/1975 | Kagoura | 70/149 X |

*Primary Examiner*—Roy D. Frazier
*Assistant Examiner*—William E. Lyddane
*Attorney, Agent, or Firm*—Larson, Taylor and Hinds

[57] ABSTRACT

A rotatable latch member having stop means thereon, a plurality of locking trains of different lengths mounted to engage and disengage the stop means to lock and unlock the latch member, and a shaft assembly selectively operable by a knob or a key having a number of teeth of predetermined length, there being a key tooth for each train, the length of that tooth depending upon the length of its train. Said knob and said key being independently operable to cause all of the locking trains to disengage the stop means to unlock the latch member.

51 Claims, 19 Drawing Figures

Fig. 11.
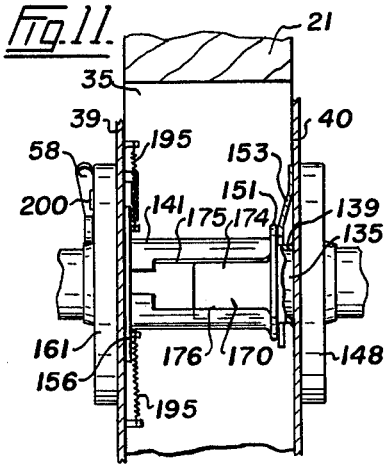
Fig. 12.
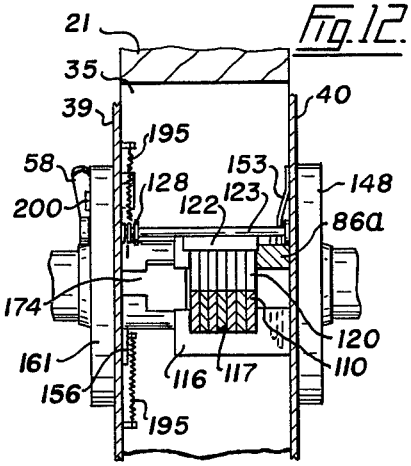
Fig. 13.
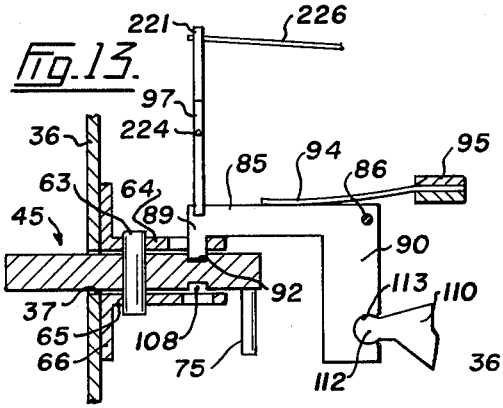
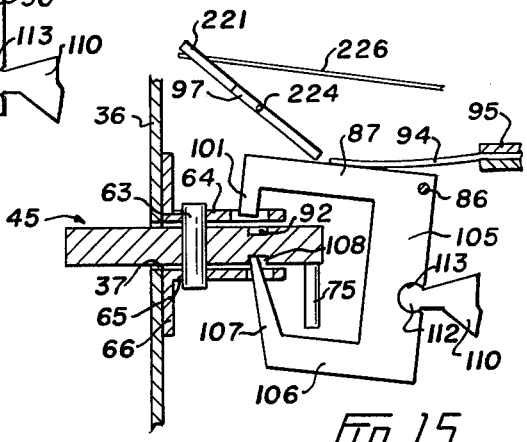
Fig. 15.
Fig. 14.
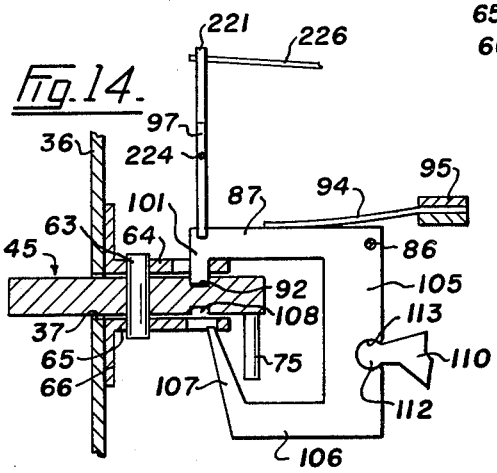

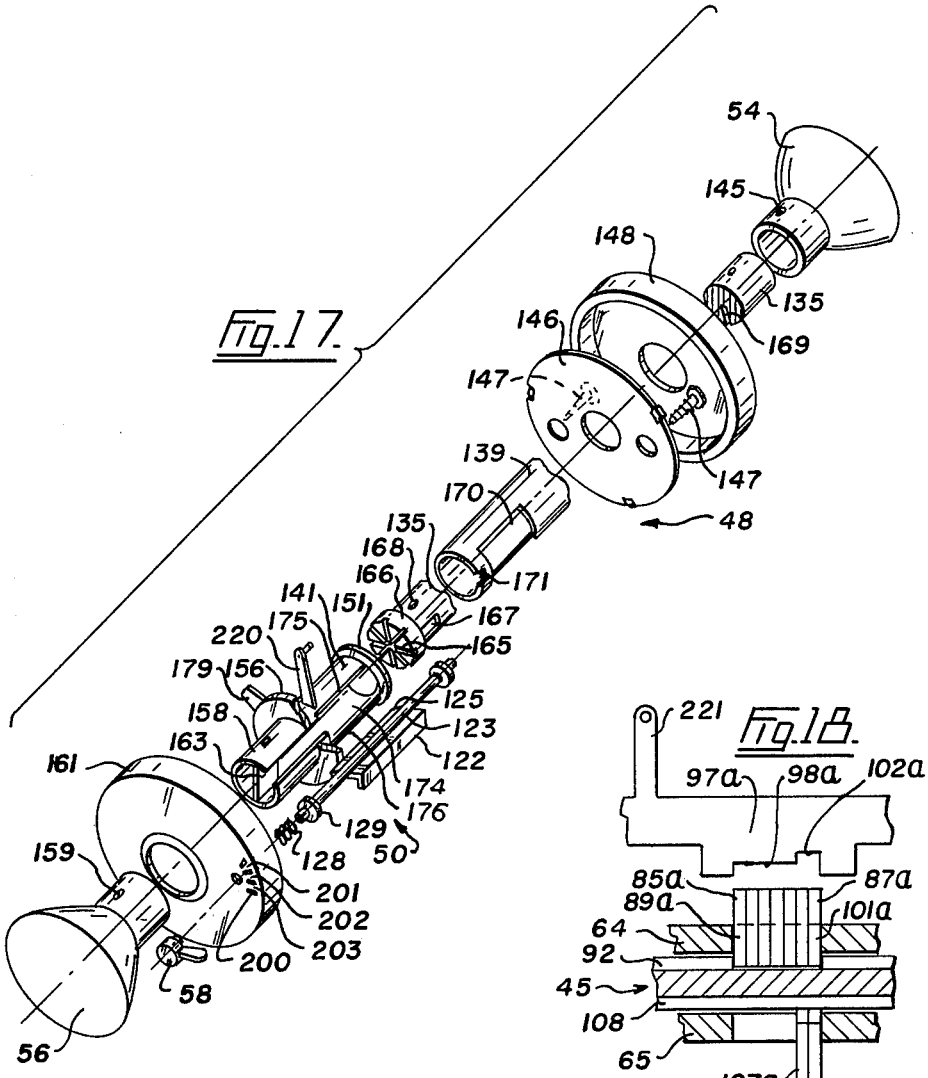
Fig. 17.
Fig. 18.
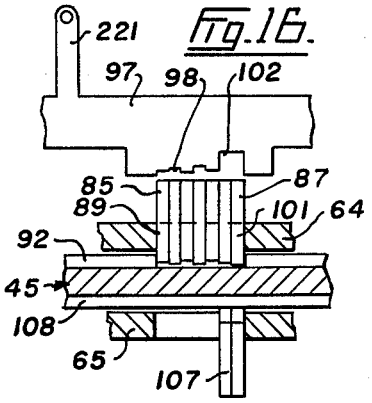
Fig. 16.
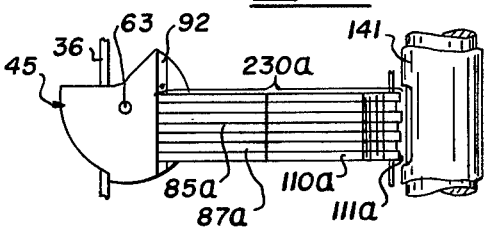
Fig. 19.

LOCK-LATCH SET

This invention relates to a lock-latch set for doors, and particularly for doors of residential apartments, houses, offices, and other enclosures.

There are a great many door locks in the prior art. However, it is relatively easy for an experienced person to make an impression of any door lock in common use in order to make a key that will open the lock, or they can be easily picked. There are key-operated locks in existence that are very difficult to open without a key, but these locks are usually very expensive and are not in general use. Furthermore, the construction of most prior locks does not permit the use of a large number of pins or tumblers. Many doors can be opened by applying a wrench or other tool to the outside knobs and exerting sufficient force to strain the locks sufficiently to open the doors.

The lock-latch set of this invention has the following important features and advantages:

1. An impression for a key to open the set cannot be made, and the set cannot be opened by picks.
2. The lock set does not have any pins or tumblers but is such that it can have a large number of locking trains, even including dummy trains, that make it practically impossible to open the set without the correct key.
3. A vast number of key tooth combinations for opening the lock are possible.
4. The lock-latch set cannot be opened by applying a wrench to the outer knob thereof.
5. No casting is required since the main parts of the lock can be stamped out, and no machining is necessary.
6. The set is of inexpensive construction as compared to the prior locks which provide maximum security.
7. A vast number of locking train combinations are available with a single set, and these combinations can very easily be changed.

A lock-latch set in accordance with the present invention comprises a latch member mounted for rotation between a lock position and an unlock position, stop means on the latch member, a plurality of locking trains of different lengths mounted for movement in one direction to engage said stop means to retain the latch member in the lock position and in an opposite direction to disengage the stop means to allow the latch member to rotate to the unlock position, and a shaft assembly selectively operable to move all of the locking trains to disengage the stop means to allow the latch member to rotate to the unlock position, said shaft assembly being operable by means of either a knob or a key having a number of teeth of predetermined different lengths, there being a key tooth for each train, and the length of each key tooth depending upon the length of the locking train of said each tooth.

Examples of this invention are illustrated in the accompanying drawings, in which:

FIG. 11 is a fragmentary vertical section taken on the line 11—11 of FIG. 4;

FIG. 12 is a vertical section taken on the line 12—12 of FIG. 4;

FIG. 13 is an enlarged vertical section through the latch member locked by a locking train;

FIG. 14 is a view similar to FIG. 13 but showing a dummy lock train in the normal lock position;

FIG. 15 is a view similar to FIG. 14 but showing the dummy train in the dummy locking position;

FIG. 16 is a fragmentary section taken on the line 16—16 of FIG. 4;

FIG. 17 is an enlarged perspective view of the shaft assembly of the lock-latch set;

FIG. 18 is a view similar to FIG. 16 illustrating an alternative form of lock train arrangement, and FIG. 19 is a plan view of the lock train arrangements of FIG. 18.

Figure 1:
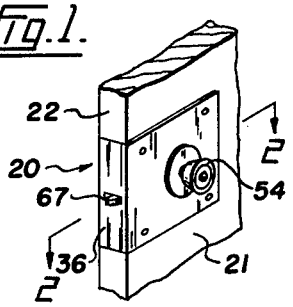
FIG. 1 is a reduced respective view of the lock-latch set mounted in a door.
Figure 2:
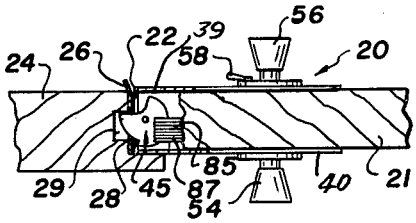
FIG. 2 is a horizontal section through the door and a door frame showing the lock-latch set partially in section.

Referring to the drawings, a lock-latch set 20 in accordance with this invention is adapted to be mounted in door 21 at the free edge 22 thereof, see FIGS. 1 and 2. The door 21 is mounted in the usual door frame or jamb 24 having a strike plate 26 mounted on a side thereof opposed to set 20 when the door is closed. The strike plate has an opening 28 therein overlying a recess 29 cut in the door frame.

The latch set 20 includes a housing 35 to be mounted in the door 21 and having an end or face plate 36 flush with the door edge 22, this face plate having an opening 37 therein which is opposed to the opening 28 in strike plate 26 when the door is closed. Housing 35 is formed with side walls 39 and 40 connected at ends thereof to the face plate, the opposite ends of these walls being secured in spaced relationship by a bar 41.

The mechanism of latch 20 includes a substantially circular latch member 45, a shaft assembly 48, see FIG. 17, and a latch locking assembly 50, shown in FIGS. 4, 5, 8 and 10. The shaft assembly 48 includes outside door knob 54 and an inside door knob 56. A catch handle 58 is located near inside knob 56. The catch handle can be shifted into and left in any of three different positions. In the first position, the latch set is free so that the door can be opened and closed from either side merely by pressure in the desired direction; in the second position, the latch set is locked and can be opened only by turning the inside knob or by means of a key 60, see FIG. 3, from the outside; and in the third position, the latch set is locked and cannot be opened by turning either the inside knob or the outside knob or by means of the key. In addition, when the latch set is locked during ordinary use, but with the catch handle out of the third position, the inside knob can be so manipulated as to open the latch set and release the outside knob. Following the opening of the door at this time, it can be latched in the closed position and then opened once from the outside by means of the outer knob, but after this has been done, it cannot again be opened from the outside without first manipulating the inside knob or by using the key. The outside knob normally is free to rotate without operating the latch set.

Latch member 45 includes a body 62 rotatably mounted on a vertical pin 63 carried by upper and lower flanges 64 and 65 of a bracket 66 fixedly mounted on the inner surface of face plate 36. The latch member is positioned between flanges 64 and 65 and has a latch 67 projecting from the body thereof, and pin 63 is so located that this latch normally projects outwardly from between the bracket flanges and through opening 37 of face plate 36, see FIGS. 4, 5, 6 and 7. Latch 67 has a shoulder 68 on one side and a curved surface 69 on its opposite side. This curved surface joins the body of member 45 at a stop shoulder 70 spaced from and extending generally at right angles to shoulder 68. A reset surface or cocking shoulder 73 extends from shoulder 68 substantially radially of the latch member on the opposite side of pin 63 from stop shoulder 70.

When the door is closed, latch 67 of latch member 45 projects outwardly through slot 37 in face plate 36 of housing 35, see FIGS. 2, 6, 7 and 8. At this time, the latch projects through opening 28 of the strike plate 26 so that, if latch member 45 is locked against rotation, the door cannot be opened. On the other hand, if the latch member is free, the door can be opened since the opening action will cause the latch member to rotate about the axis of pin 63 to the position shown in FIG. 7.

Figure 6:
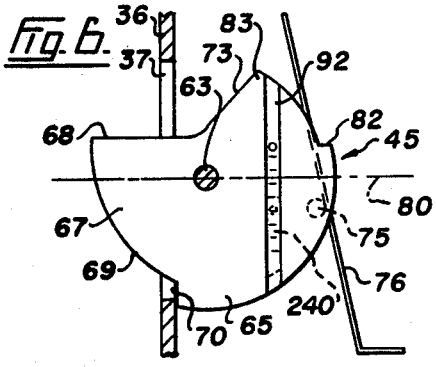
FIG. 6 is an enlarged plan view of the latch member in the lock position.
Figure 7:
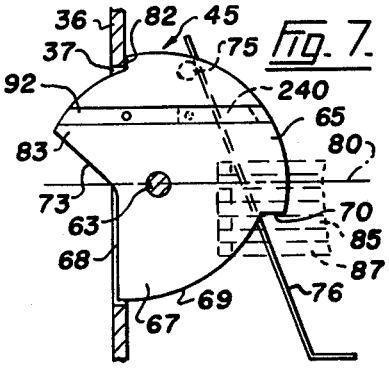
FIG. 7 is a plan view of the latch member in the unlock position.
Figure 8:
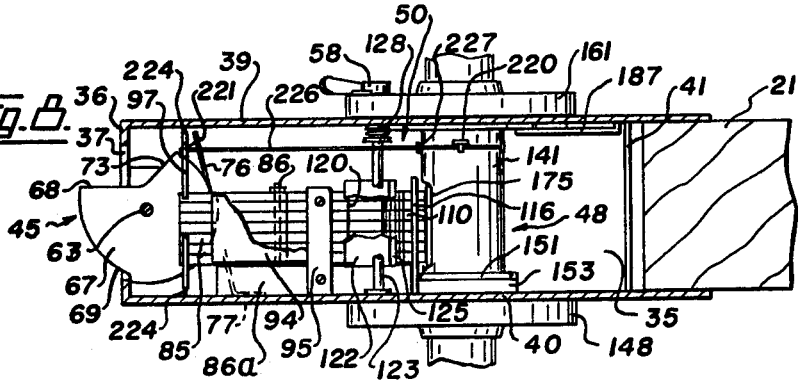
FIG. 8 is a horizontal section taken on the line 8—8 of FIG. 4.

A pin 75 projects downwardly from latch member 45 at or near the inner edge thereof, and a spring 76 which is mounted on wall 40 of housing 35 at 77, see FIG. 8, extends angularly across the housing and engages this pin. When pin 75 is located on one side of a center line 80, which is perpendicular to face plate 36 and extends through pin 63, the spring pressing against pin 75 causes member 45 to rotate until stop shoulder 70 engages the inner surface of the face plate 36, as shown in FIGS. 6 and 7. When the door is opened, latch member 45 is rotated by this action, and pin 75 is moved against the tension of spring 76 to the opposite side of center line 80, so that the spring can rotate the latch member until a stop 82 on said member engages the inner surface of face plate 36, at which time the corner 83 of the latch member projects outwardly through slot 37, see FIG. 7. When the door is closed, corner 83 engages strike plate 26 so that continued closing movement of the door causes the latch member to rotate to shift pin 75 back across center line 80 to enable spring 76 to rotate the latch member into the position with latch 67 projecting into the strike plate opening 28.

The latch locking assembly 50 is positioned between latch member 45 and the shaft assembly 48. The locking assembly 50 includes a plurality of thin blade-like lifters or locking arms 85 swingably and removably mounted on a rod 86 which extends transversely of housing 35. This rod is secured to and projects laterally from a block **86*a* mounted on housing wall 40 and has a nut 86*b* threaded thereon to retain rods 86 in place. There may be any desired number of these lifters 85 located side by side, there being five shown in the drawings for the sake of convenience, but there may be more or fewer of these arms. Although not absolutely necessary, there preferably are a plurality of thin blade-like safety lifters or locking arms 87 swingably mounted on rod 86, one of which is shown in FIGS. 14 and 15. For example, there may be from 10 to 13 arms 85 and from 2 to 4 arms 87**.

Figure 4:
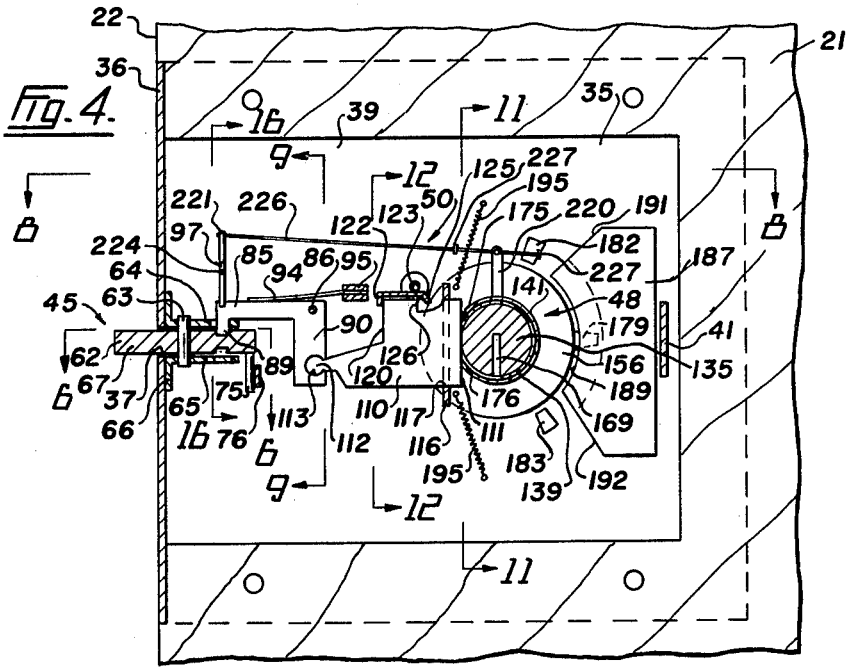
FIG. 4 is an enlarged vertical section through the lock latch set shown in the lock position.
Figure 5:
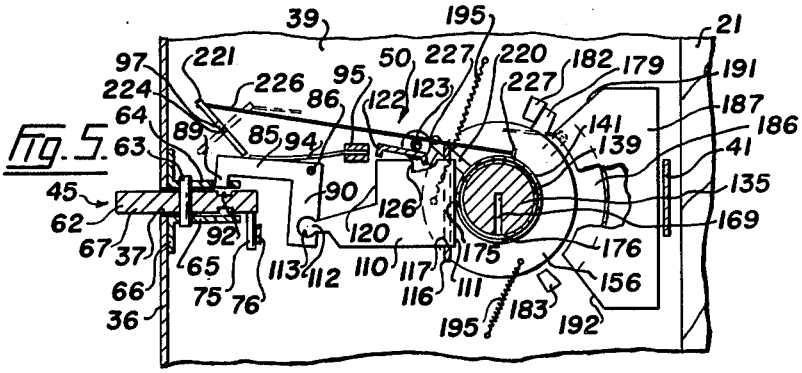
FIG. 5 is a fragmentary view similar to FIG. 4 but showing the set in the unlocked position.

Each arm 85 is of substantially inverted U-shaped in elevation, as shown in FIGS. 4, 5 and 13, and has a lug 89 projecting downwardly from its outer end, and downwardly-extending connector 90 at its inner end. Each lug 89 projects downwardly from its arm 85 and when the arm is in its normal position engages stop means on latch member 45, and in this example, the stop means comprises a recess 92 formed in the upper surface of latch member 45 into which the lug fits. At this time the latch 67 of the latch member is in the latching position extending through slot 37 of face plate 36. The lugs 89 of the arms 85 are of different lengths, as shown in FIG. 16. There may be one relatively lpng recess 92 large enough to receive all of the arm lugs 89, as shown, or there may be a separate recess 92 for each lug. A flat spring 94 has one end bearing against the top edges of arms 85, the opposite end of this spring being carried by a bar 95 mounted on and projecting from block **86*a*, see FIG. 8. As an alternative, spring 94 can be divided into a plurality of narrow springs, one for each arm 85. Spring 94 biases the arms downwardly so that when recess 92 is positioned below lugs 89, these lugs fit into the recess to prevent latch member 45 from turning. A limit bar 97 above and extending across the outer ends of arms 85 over the lug thereof is removably mounted at its ends on walls 39 and 40. This bar has a stop 98 recessed in the lower surface thereof for and in line with each arm 85. The stops 98 are of different depths in the bar corresponding to the lengths of the lugs 86 of their respective arms 85, see FIG. 16**. If a lug is short, its corresponding stop is shallow, and if a lug is longer, its stop is deeper in the bar, and so on.

By referring to FIGS. 14 and 15, it will be seen that safety arms 87 are similar to arms 85 and have lugs 101 of different lengths projecting down from their outer ends into recess 92 of latch member 45. Recesses 102 in bar 97 above lugs 101 are so deep that the arms 87 never contact them. If two arms 87 are side by side, as shown in FIG. 16, the recess 102 thereof may be combined as one relatively large recess. However, it is preferable to interleave arms 87 with arms 85, in which case recesses 102 in the limit bar would accordingly be located between stops 98.

Each arm 87 has a connector 105 projecting downwardly from its inner end, each of these connectors being longer that the connectors 90 of arms 85. Each connector 105 has a horizontal section 106 at its lower end and extending outwardly beneath arm 87, and each of these sections has an upwardly-extending finger 107 which terminates below latch member 45 when the lug 101 of that lock arm is positioned in recess 92 of latch member 45. The length of finger 107 is such that when arm 87 is tipped so that its lug 101 is just clear of the top of latch member 45, the end of the finger is just clear of the bottom of said latch member. However, if the locking arm is tipped further, the end of finger 107 engages stop means in the form of a recess 108 formed in the bottom of latch member 45 the same size as and directly under the recess 92 thereof. As finger 107 is in recess 108 at this time, the latch member cannot rotate.

A slide member or pusher 110 is provided for and in line with each of the arms 85 and 87. Each slide member 110 has an inner end 111 and a circular head 112 on its outer end fitting within a correspondingly shaped recess 113 formed in the adjacent arm connector 90 or 105. The slide members 110 extend into the adjacent connectors with their heads 112 rotatably fitting in recesses 113 of the respective connectors. The slide members 110 are flat and blade-like the same as arms 85 and 87, and are mounted for horizontal sliding movement on a bar 116 having a large notch 117 therein in which the members or pushers 110 slidably fit. With this arrangement, horizontal movement of any slide member 110 causes the arm 85 or 87 connected thereto to swing around rod 86. Outward movement of the slide members causes arms 85 and 87 to rotate to lift lugs 89 and 101, respectively, out of recess 92 to release latch member 45, while inward movement of the slide members causes said arms to swing in the opposite direction to shift the lugs 89 and 101 into recess 92 if the latter is positioned beneath these lugs. This inward movement of the slide members is caused by springs 94 bearing down on the arms 85 and 87 to cause the latter to rotate around rod 86. If any arm 87 is swung around rod 86 too far, its finger 107 enters lower recess 108 to prevent rotation of the latch member.

Each member 110 is formed with a shoulder 120 on its upper edge, and the shoulders of these members can be engaged by an angular catch 122 mounted on a rod 123 which extends transversely of housing 35 and is rotatably mounted on the walls thereof. One end of this rod extends through the adjacent housing wall 39 and has handle 58 fixedly mounted thereon. This rod can be rotated by a handle 58 into one position to disengage catch 122 from slide member shoulders 120 to release the slide members so that they can be moved, to a second position engaging the shoulders 120 to prevent movement of the slide members out of their normal latching positions, and to a third position in which a projection 125 formed on catch 122 and projecting away therefrom on the opposite side of rod 123 to engage another shoulder 126 formed on each slide member 110 after said slide member has been moved to its latch release position to prevent the slide member from returning to the latching position. A spring 128 on rod 123 bears against a stop 129 on the rod to bias the latter in the direction towards housing wall 39.

The shaft assembly 48 consists generally of shaft 135, a stationery inner sleeve or member 139, and a rotatable outer sleeve or member 141, see FIG. 17. Sleeve 139 is prevented from rotating in any desired manner, and in this example, it is welded to casing wall 40, see FIG. 11. Shaft 135 projects outwardly through wall 40 of housing 35 and through a hole in door 21, and outer knob 54 is fixedly secured thereto in any desired manner, such as by means of a screw 145. The shaft also extends through an anchor plate 146 which is adapted to be secured to the outer surface of the door by screws 147, and through an end plate 148 which snaps on plate 146 in the usual manner. The shaft 135 is rotatable within the inner sleeve, while outer sleeve 141 is rotatably mounted on said inner sleeve and has an enlarged end 151. A spring 153 mounted on wall 40 and bearing against the enlarged end 151 biases sleeve 141 in the direction towards wall 39.

Outer sleeve 141 has a collar 156 fixed thereto and spaced from the ends thereof, said collar being urged against the inner surface of the wall 39 of housing 35 by spring 153. End section 158 of sleeve 141 extends through the housing wall and the door and into inner knob 56 to which it is secured by a set screw 159. The end section 158 of sleeve 141 also extends through an end plate 161 which bears against the inner surface of the door. A flat key lug 163 extends across the interior of end section 158 near the outer or free end thereof. This key or lug is positioned to fit into one of a plurality of radiating slots 165 formed in a head 166 removably mounted on the inner end of shaft 135 and a little larger in diameter than said shaft. In this example, head 166 has a prong 167 projecting therefrom into a corresponding slot in the end of shaft 135, and a set screw 168 is threaded into the shaft so that it can bear against this prong releasably to secure the head to the shaft.

A key slot 169 is formed in and extends the length of shaft 135 and opens outwardly from a side thereof. This slot, when the shaft is in its normal position, opens laterally into a cut-out section 170 formed in sleeve 139 and extending longitudinally thereof and terminating short of the ends of the sleeve. A notch 171 is formed in sleeve 139 at the inner end thereof. Outer sleeve 141 has a larger cut-out section or slot 174 which overlies sleeve cut-out section 170 and has upper and lower edges 175 and 176 which extend longitudinally of the outer sleeve.

A lug 179 radiates from the edge of sleeve collar 156. This lug, when sleeve 141 is in its normal position, lies substantially midway between upper and lower stops 182 and 183 mounted on and projecting inwardly from the adjacent wall 39 of housing 35, see FIGS. 4 and 5. Spring 153 bearing against sleeve flange 151 normally retains collar 156 against the inner surface of housing wall 39, and if sleeve 141 is rotated by means of handle 56 at this time, lug 179 can travel between stops 182 and 183. The lug is normally midway between the stops, at which time it is located in a passage 186 formed by a plate 187 mounted on and spaced inwardly from wall 39, see FIGS. 4, 5 and 8. This plate has an inner edge 189 which is curved around and spaced from the edge of collar 156. This plate also has edges 191 and 192 spaced from stops 182 and 183, respectively. With this arrangement, handle 56 and sleeve 141 normally cannot be shifted axially inwardly against spring 151 because lug 179 is position at this time in slot 186 beneath plate 187. However, if handle 56 is rotated to move lug 179 against either stop 182 or 183, the handle can be moved inwardly against the tension of spring 153 since lug 179 will travel through the space between stop 182 and plate edge 191 or the space between stop 183 and plate edge 192. If knob 56 is rotated back towards its normal position while it is depressed, lug 179 rides over the surface of plate 187 so that the knob is retained in the depressed position. In other words, lug 179 and plate 187 constitute holding means for retaining knob 56 and sleeve 141 in the depressed condition. A pair of springs 195, see FIGS. 4 and 5, are each connected at one end to collar 156 and at an opposite end to wall 39. These springs allow the collar and consequently knob 56 to be rotated back and forth, and when the knob is released, these springs return it to its normal position with lug 179 midway between stops 182 and 183 and in passage 186.

When the inner knob 56 is being depressed, sleeve 141 moves inwardly with it over inner sleeve 139. As key 163 moves with sleeve 141, it engages the head 166 of shaft 135 and fits into one of the radiating slots 165 thereof. When knob 56 is released, and lug 179 is adjacent either stop 182 or 183, spring 153 moves sleeve 141 axially to separate key 163 from head 166.

By referring to FIG. 17, it will be seen that a plurality of spaced humps 200 are formed on the outer surface of end plate 161 adjacent catch handle 58. These humps are spaced apart to provide positions 201, 202, and 203 in to which handle 58 can be moved, these humps retaining the handle in the positions therebetween. Spring 128 on rod 123 retains the handle in any position into which it is moved, but the spring allows the handle to be moved over the humps when it is being shifted manually into different positions.

Figure 3:
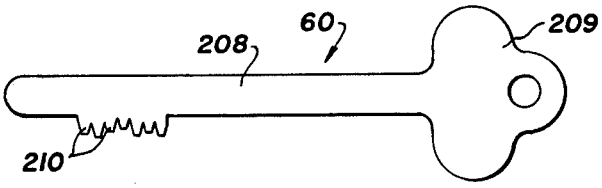
FIG. 3 is an enlarged elevation of a key for this lock set.

Referring to FIG. 3, key 60 consists of a flat bar 208 projecting from a head 209, said bar having a plurality of teeth or lugs 210 on one edge thereof. These lugs are of different lengths, and if there are five arms 85 and two arms 87 in the apparatus, there are seven of these teeth, one for each of the slide bars 110 connected to arms 85 and 87.

When the locking lugs 89 and 101 are raised out of recess 92 of latch member 45 by a key 60 inserted into and along slot 169 of shaft 135 and having the correct arrangement of teeth 210, arms 85 are raised different distances to clear lugs 89 from the recess, the upward movement of these arms being limited by the stops 98 in bar 97. On the other hand, rotation of sleeve 141 by means of the inner knob 56 causes all of the arms 85 to be raised the same distance. As a result, it is necessary to get the bar stops 98 out of the way. For this purpose, lugs 220 and 221 are fixed to and project upwardly from sleeve 141 and bar 97, respectively. This bar is mounted by pivot pins 224 at its opposite ends, see FIG. 8, on housing walls 39 and 40. A connecting rod 226, see FIGS. 4 and 8, interconnects these lugs 220 and 221. Lug 220 is actually slidably connected to rod 226 and moves the latter by engaging spaced stops 227 on said rod when sleeve 141 is rotated. Rotation of sleeve 141 around its longitudinal axis in either direction causes, through the linkage comprising lugs 220 and 221 and rod 226, bar 97 to swing in either direction around pins 224 to shift stops 98 out of line with the arms 85.

Figure 10:
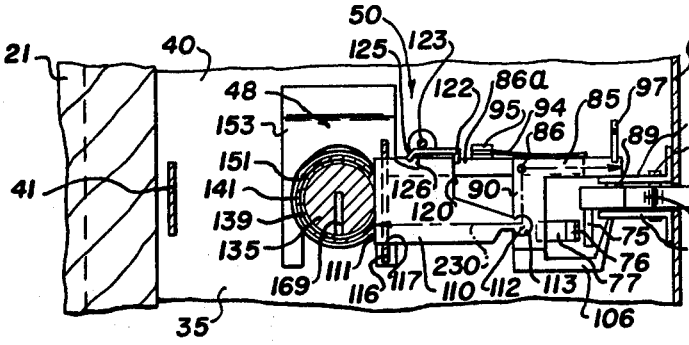
FIG. 10 is a fragmentary vertical section through the set reversed relative to the view shown in FIG. 4, this section being on the line 10—10 of FIG. 9.
Figure 9:
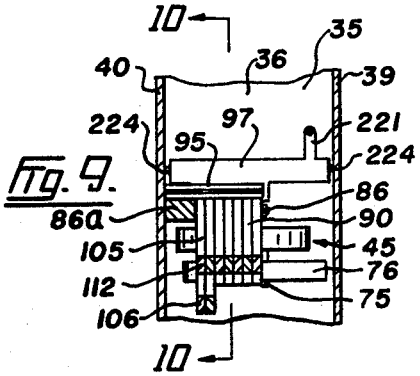
FIG. 9 is a fragmentary cross section taken on the line 9—9 of FIG. 4.

It will be noted that each slide member 110, the locking arm 85 or 87 connected thereto and the respective lug 89 or 101 of said arms constitute a locking train 230, indicated in FIG. 10, extending from a tooth 210 of key 60 in shaft slot 169 or sleeve 141 to latching member 45. These trains 230 are of different lengths, and the length of each train determines the length of key tooth or the throw (amount of rotational movement) of sleeve 141 necessary to relaease said train from latching member 45. In the illustrated example, the lengths of these trains is determined by the lengths of the lugs 89 and 101. The trains involving arms 87 are in effect dummy trains in that movement of the latter trains can lock the latching member against rotation.

As an alternative, the lengths of the trains 230*a* can be determined by the lengths of the slide members 110*a*, see FIGS. 18 and 19. In this example, the lugs 89*a* and 101*a* are all of the same length, the stops 98*a* of bar 97*a* are all spaced the same distance above the arms 85*a* and the lengths of slide members 110*a* are different. As a result, the ends 111*a* of members 110*a* are spaced different distances from shaft 135 and sleeve 141. This spacing determines the lengths of the key teeth required to move the individual locking trains. Rotation of sleeve 141 can shift all of the trains sufficiently to clear the latching member since bar 97*a* is simultaneously swung out of the way by the rotating sleeve.

The operation of lock-latch set 20 is as follows:

When the door is retained in the closed position by latch 67 projecting into strike plate opening 28, the lugs 89 and 101 are retained in recess 92 of latch member 45 by springs 94, thereby preventing rotation of the latch member. The door cannot be opened at this time. If outer knob 54 is rotated, all that happens is that shaft 135 rotates without affecting slide members 110, arms 85 and 87, and lugs 89 and 101. Thus, the door cannot be opened from the outside, and as knob 54 is free to rotate at this time, there would be no use in applying a wrench to the outer knob in an effort to try to force the latch open. On the other hand, if knob 56 is rotated, sleeve 141 is rotated thereby to cause either edge 175 or 176, depending upon the direction of rotation of the knob, to engage adjacent ends 111 of slide members 110 which extend across the cut-out section 174 of the sleeve and bear against these ends. This shifts slide members 110 longitudinally, causing arms 85 and 87 to rotate simultaneously and the same distance on rod 86 thereby lifting lugs 89 and 101 out of recess 92 to free latch member 45. At the same time lugs 220 and 221 and rod 226 swing bar 97 to shift stops 98 out of the way to permit this action. As there is now nothing to prevent rotation of the latch, the door can be swung towards the open position, latch member 45 rotating at this time. When the door is closed, reset surface 73 engages the end of strike plate 26 to rotate the member 45 back towards its normal position. If knob 56 is release at this time, lugs 89 and 101, which are above or on the upper surface of the latch member, drop back into recess 92 to lock the latch member against rotation.

Key 60 is necessary to unlock the door from the outside. The end of shaft 135 is exposed through outer knob 54, and the key is inserted into slot 169 of said shaft and moved inwardly as far as it will go. At this time, the key teeth 210 are opposite cut-out sections 170 and 174 of inner sleeve 139 and outer sleeve 141, respectively, and are in alignment with the inner ends 111 of slide members 110. If the key is the correct one, it can now be turned, shaft 135 turning with it. However, sleeve 141 remains stationary at this time, and therefore bar 97 remains in its normal position.

If the key is not the correct one for this latch the length of the teeth 210 will not be such as to move every slide member 110 to lift the lugs 89 and 101 associated therewith out of latch member recess 92. For example, if it takes a short key tooth to lift a given lug 89 out of recess 92 of latch member 45, a longer key tooth will attempt to lift the lug out of the latch member recess but the arm 85 of that lug will engage the stop 98 in bar 97 above said lug. This may lift the lug out of the recess, but the key cannot rotate any further since the long lug is bearing against the corresponding slide member 110 which cannot move any further. On the other hand, if it requires a long key tooth to lift a given lug 89 out of the member recess 92, a shorter lug will not move the corresponding slide member 110 sufficiently to lift the lug out of the recess.

Arms 85 and their associated elements will function perfectly well without arms 87, but the latter have been included as an additional safety feature. It is possible for an experienced person to ascertain the key tooth arrangement of many prior locks by inserting a feeler where the key is usually inserted into the lock and then feeling how far each tumbler can be moved to allow the lock to open. Furthermore, the tumblers of prior locks can be moved by picks. However, it is practically impossible to open this lock by picks or feelers even without arms 87 being present because of the large number of locking trains involved. This large number is possible because of the flat blade-like construction of arms 85 and 87, their respective lugs and slide members 110.

With arms 87 present, it is impossible to open this lock by means of feelers or picks. If a feeler or pick is inserted in the shaft slot and is operated to move the slide member of an arm 87 sufficiently to cause the latter to swing upwardly as far as it will go, the finger 107 of that arm will move up into the lower slot 108 of member 45 to prevent rotation of the latter. Thus, if a key is made with a tooth long enough to cause this movement of the arm 87, the key will not release latch member 45 since finger 107 will be in the slot 108 to prevent rotation of the latch member. In order to release the latch member, the corresponding tooth of the key must move the arm 87 only sufficiently to clear the lug 101 from slot or recess 92 at which time the free end of the corresponding finger 107 will be just clear of slot 108 so that latch member 45 can be rotated. As there preferably are two or more arms 87, and as these can be interleaved anywhere with the arms 85, it is impossible for a person to arrive at the necessary key tooth pattern by utilizing a feeler or pick. Even if a person purchases one of these locks to study the construction and operation, he could not open another lock because of the vast number of combinations of locking trains available with from 10 to 15 locking trains of different lengths.

If the catch handle 58 is shifted into its third position 203, catch 122 will engage shoulders 120 of the slide members 110 so that these members cannot be moved by rotating either knob 54 or knob 56 or by use of the correct key 60. If handle 58 is moved to its second position 202, catch 122 is clear of the slide members 110 so that the latch functions in the usual manner, that is, it can be opened by turning inner knob 56 or by the use of the correct key 60. If handle 58 is moved to its first position 201 while inner knob is retained in its latch-release position, lug 125 of the catch engages shoulders 126 of slide members 110 to prevent return of said members by springs 97, thereby leaving latch member 45 free to rotate. At this time, it is only necessary to move door 21 in the desired direction to open or close it. Spring 76 bearing against pin 75 will normally prevent latch member 45 from rotating thereby retaining the door in its closed position, but sufficient pressure against the door to open it will cause latch member 45 to rotate against the pressure of spring 76, thereby allowing the door to open.

As stated, the lock latch set 20 can be set so that door 21 can be opened from either side without a key and even without having to turn a knob. However, the set 20 can be operated so that the door can only be opened by turning inside knob 56 from the inside or by the correct key 60 from the outside. In addition, the set can be operated so that it cannot be opened by turning knob 56 or by means of the correct key without turning catch handle 58 to the correct position.

If a person is to go out through the door and wants to get back in without the necessity of using a key and wants the door automatically to lock when it is closed after his return, inner knob 56 is rotated to turn sleeve 141 to release latch member 45, allowing the door to be opened. As lug 179 of collar 156 is now clear of plate 187, the knob can be depressed until key 163 of sleeve 141 engages in a notch 165 of head 166 on the inner end of shaft 135. Lug 179 rides on top of plate 187 when the knob is returned to its normal position while it is being depressed. The door can now be closed without interferring with this arrangement. This setting enables a person to open the door by turning outer knob 54 since this rotates sleeve 141 through shaft 135 and key 163. When lug 179 clears plate 187, spring 153 shifts the outer sleeve to cause lug 179 to move beneath said plate when the sleeve returns to its normal position. Key 163 is now clear of shaft head 166 and the closing of the door causes it to be locked in the closed position.

When it is desired to change the key that will open the latch set, arms 85 and 87 can be removed from rod 86 and reassembled in different order. Bar 97 would have to be changed at this time so that its stops 98 would be the right depth for the arms 85 and 87 positioned beneath them, and a new key would be cut having teeth 210 arranged in the correct pattern for the new setting of the latch arms.

The illustrated latch set is set so that door 21 opens inwardly. If it is intended that the door open outwardly, it is only necessary to turn latch member 45 over, in which case recesses 92 and 108 change positions and purposes. In this case, it may be necessary to insert a filler 240, shown in broken lines in FIGS. 6 and 7, in recess 108 near one end thereof in order to be sure that none of the lugs 89 or 101 drop down into said recess when latch member 45 is in the unlatch position.

I claim:

1. A lock-latch set comprising:

a latch member mounted for rotation between a lock position and an unlock position, stop means on the latch member, a plurality of locking trains of different lengths, mounted for movement in opposite directions between a locking position and a release position, said trains each having a pivotally mounted outer end portion positioned to engage said stop means and an opposite slidably mounted inner end portion, said outer end portion when the trains are moved to a locking position engaging the stop means to retain the latch member in the lock position and when the trains are oppositely moved to the release position disengaging the stop means to allow the latch member to rotate to the unlock position, and a shaft assembly mounted adjacent said inner end portions of the locking trains, said assembly having means for receiving a key having a number of teeth of predetermined lengths corresponding to the different lengths of the locking trains with said teeth positioned to engage the train inner end portions, said assembly allowing the key to be turned to permit the key teeth to engage said respective inner end portions to move the locking trains to the release position to allow the latch member to rotate.

2. A lock-latch set as claimed in claim 1 comprising:

a movable member in said shaft assembly positioned, on movement, to engage the inner end portions of the locking trains to move said trains in said opposite direction to allow the latch member to rotate, and a knob connected to said member by means of which said member can be moved to engage the inner end portions to move the locking trains in said opposite direction.

3. A lock-latch set as claimed in claim 2 comprising catch means selectively operable to one position to prevent movement of the locking trains in said opposite direction to disengage the stop means, or to another position to prevent movement of the trains in said one direction to engage the stop means, or to a further position to allow movement of the trains in both of said directions.

4. A lock-latch set as claimed in claim 2 in which said stop means comprises a recess in the latch member, and said outer end portion of each locking train comprises a lug movable by said each train into the recess to prevent rotation of the latch member and out of the recess to permit rotation of said member.

5. A lock-latch set as claimed in claim 2 comprising second stop means on the latch member, and at least one additional locking train similar to and normally movable with the first-mentioned locking trains and acting as a dummy train, said dummy train comprising a finger thereon positioned normally disengaged from the second stop means and engaging said second stop means to retain the latch member in the lock position when said dummy train is shifted more than the normal movement thereof.

6. A lock-latch set as claimed in claim 2 in which each train comprises a locking arm, a lug on an end of the arm and forming said outer end portion of the train and positioned to engage said stop means, means swingably mounting the locking arm, means biasing the arm to cause the lug thereof to engage the stop means, said arm being swingable to move the lug thereof out of engagement with said stop means, and a slide member mounted for longitudinal movement and connected to the locking arm whereby back and forth movement of the slide member oscillates the locking arm on the mounting means thereof, said slide member having an end forming said inner end portion of the train and positioned to be engaged by the respective tooth of said key or by said movable member and moved thereby longitudinally to oscillate the locking arm against the biasing means thereof to disengage said arm lug from the stop means.

7. A lock-latch set as claimed in claim 6 in which said locking arm of each train and the lug thereof and the slide member connected thereto are of flat blade-like formation, and the locking trains are located side by side.

8. A lock-latch set as claimed in claim 6 in which each slide member is connected to the respective locking arm thereof by a circular head on an end of the slide member rotatably fitting in a circular recess formed in the locking arm and opening out from an end thereof facing said slide member.

9. A lock-latch set as claimed in claim 2 including means releasably and selectively retaining the latch member in the lock position and in the unlock position.

10. A lock-latch set as claimed in claim 2 in which said latch member comprises a body having a latch projecting therefrom, first stop means on the body permitting rotation of the latch member in one direction from the lock position and preventing rotation in the opposite direction, and second stop means on the body permitting rotation of the latch member from the unlock position and preventing rotation in the opposite direction therefrom.

11. A lock-latch set as claimed in claim 10 in which said latch member body is rotatable around a central axis, said latch member comprising a toggle arrangement releasably retaining the latch member in the lock position, allowing the latch member to rotate between the lock position and unlock position, and releasably retaining the latch member in the unlock position.

12. A lock-latch set as claimed in claim 10 in which said latch member body is rotatable around a central axis and said latch extends substantially along a center line passing through said axis, said latch member comprising a pin mounted on the latch member body spaced from the axis on the side thereof remote from the latch, and spring means bearing against the pin, said spring means being positioned releasably to retain the pin on one side of said center line when the latch member is in the lock position, and to allow the latch member to be rotated between the lock position and the unlock position, and releasably to retain the pin on the opposite side of the center line when the latch member is in the unlock position.

13. A lock-latch set as claimed in claim 2 in which said latch member is mounted in a housing for rotation around a central axis, said latch member comprising a body having a latch projecting therefrom and projecting out of the housing when the latch member is in the lock position, and a cocking shoulder projecting from the latch member body circumferentially spaced from the latch, said shoulder projecting from the housing when the latch member is in the unlock position.

14. A lock-latch set as claimed in claim 2 in which said latch member is mounted in a housing for rotation around a central axis, said latch member comprising a body having a latch projecting therefrom and projecting out of the housing when the latch member is in the lock position, a cocking shoulder projecting from the latch member body circumferentially spaced from the latch, said shoulder projecting from the housing when the latch member is in the unlock position, first stop means permitting rotation of the latch member in one direction from the lock position and preventing rotation in the opposite direction, and second stop means permitting rotation of the latch member from the unlock position and preventing rotation in the opposite direction therefrom.

15. A lock-latch set as claimed in claim 14 in which said latch member comprises a toggle arrangement releasably retaining the latch member in the lock position, allowing the latch member to rotate between the lock position and unlock position, and releasably retaining the latch member in the unlock position.

16. A lock-latch set as claimed in claim 2 in which said movable member of the shaft assembly comprises a sleeve mounted for rotation around a longitudinal axis, said sleeve having a slot therein extending longitudinally thereof and forming spaced longitudinally-extending edges, said sleeve being so positioned relative to said locking trains that when the sleeve is rotated in either direction around the longitudinal axis thereof, one of said edges engages said inner end portions of the locking trains to move all of said trains in said opposite direction to disengage the stop means of the latch member to allow said member to rotate to the unlock position.

17. A lock-latch set as claimed in claim 16 in which said knob is connected to said sleeve by means of which the sleeve can be rotated around the longitudinal axis thereof.

18. A lock-latch set as claimed in claim 2 in which said shaft assembly comprises a shaft mounted for rotation around a longitudinal axis, and said means for receiving a key comprising a key slot in and extending longitudinally of the shaft and opening laterally out therefrom, said slot opening out from an outer end of the shaft, said key being insertable in and movable longitudinally of said slot with the key teeth projecting laterally from the shaft, said shaft being so positioned relative to said locking trains that when the shaft with the key therein is rotated around the longitudinal axis of the shaft, said key teeth engage their respective trains to move all of said trains in said opposite direction to disengage the stop means of the latch member to allow said member to rotate to the unlock position.

19. A lock-latch set as claimed in claim 18 including a knob connected to said shaft by means of which said shaft can be rotated around the longitudinal axis thereof.

20. A lock-latch set as claimed in claim 2 in which said movable member of the shaft assembly comprises a sleeve mounted for rotation around a longitudinal axis, said sleeve having a slot therein extending longitudinally thereof and forming spaced longitudinally-extending edges, said sleeve being so positioned relative to said locking trains that when the sleeve is rotated in either direction around the longitudinal axis thereof, one of said edges engages the inner end portions of the locking trains to move all of said trains in said opposite direction, a shaft extending into the sleeve and mounted for rotation around the longitudinal axis of said sleeve independently of the sleeve, and said means for receiving a key comprising a key slot in and extending longitudinally of the shaft and opening laterally out therefrom towards said sleeve slot, said shaft slot opening out from an outer end of the shaft remote from the sleeve, said key being insertable in and movable longitudinally of the shaft slot with the key teeth projecting laterally from the shaft and out through the sleeve slot, said shaft being so positioned relative to said locking trains that when the shaft with the key therein is rotated around the longitudinal axis of the shaft, said key teeth engage their respective trains to move all of said trains in said opposite direction.

21. A lock-latch set as claimed in claim 20 including a slot in the end of the shaft in the sleeve, a key lug in the sleeve engageable with said end slot, and means normally biasing the sleeve to retain the key lug clear of the shaft end slot, said sleeve being longitudinally movable against said biasing means to bring the key lug into engagement with the end slot whereby rotation of the shaft at this time without a key in the slot thereof rotates the sleeve to move the locking trains thereby.

22. A lock-latch set as claimed in claim 21 including holding means for releasably retaining the sleeve in the position with the key lug thereof in engagement with the shaft end slot.

23. A lock-latch set as claimed in claim 20 including holding means operable, when the sleeve is rotated around its longitudinal axis to move the locking trains and then moved back again, to retain the sleeve in the position with the key lug thereof in engagement with the shaft end, said holding means releasing the sleeve when said sleeve is next rotated to move the locking trains to allow the biasing means to shift the sleeve longitudinally to disengage the key lug from the shaft end slot.

24. A lock-latch set as claimed in claim 20 comprising catch means selectively operable to one position to prevent movement of the locking trains in said opposite direction to disengage the stop means, or to another position to prevent movement of the trains in said one direction to engage the stop means, or to a further position to allow movement of the trains in both of the said directions.

25. A lock-latch set comprising:

a latch member mounted for rotation between a lock position and an unlock position, stop means on the latch member, a plurality of locking trains of different lengths mounted side by side for individual movement in opposite directions between a locking position and a release position, said trains each having a pivotally mounted outer end portion and an opposite slidably mounted inner end portion, said outer end portions when the trains are moved to the locking position engaging the stop means and when the trains are oppositely moved to the release position disengaging the stop means, engagement of one or more of said outer end portions of the trains with the stop means retaining the latch member in the lock position, and movement of all of said trains to the release position allowing the latch member to rotate to the unlock position, and a shaft assembly mounted adjacent said inner end portions of the locking trains, said assembly having means for receiving a key having a number of teeth of predetermined lengths corresponding to the different lengths of the locking trains with said teeth positioned to engage the train inner end portions, said assembly allowing the key to be turned to permit the key teeth to engage said respective inner end portions to move the locking trains to the release position to allow the latch member to rotate.

26. A lock-latch set as claimed in claim 25 comprising:

a movable member in said shaft assembly positioned, on movement, to engage the inner end portions of the locking trains to move said trains in said opposite direction to allow the latch member to rotate, and a knob connected to said member by means of which said member can be moved to engage the inner end portions to move the locking trains in said opposite direction.

27. A lock-latch set as claimed in claim 26 comprising second stop means on the latch member, and at least one additional locking train similar to and normally movable with the first-mentioned locking trains and acting as a dummy train, said dummy train comprising a finger thereon positioned normally disengaged from the second stop means and engaging said second stop means to retain the latch member in the lock position when said dummy train is shifted more than the normal movement thereof.

28. A lock-latch set as claimed in claim 26 in which each train comprises a locking arm, a lug on an end of the arm and forming said outer end portion of the train and positioned to engage said stop means, means swingably mounting the locking arm, means biasing the arm to cause the lug thereof to engage the stop means, said arm being swingable to move the lug thereof out of engagement with said stop means, and a slide member mounted for longitudinal movement and connected to the locking arm whereby back and forth movement of the slide member oscillates the locking arm on the mounting means thereof, said slide member having an end forming said inner end portion of the train and positioned to be engaged by the respective tooth of said key as by said movable member and moved thereby longitudinally to oscillate the locking arm against the biasing means to disengage said lug from the stop means.

29. A lock-latch set as claimed in claim 28 in which said lugs are of different lengths thereby determining the lengths of their respective trains.

30. A lock-latch set as claimed in claim 28 in which said slide members are of different lengths thereby determining the lengths of their respective trains.

31. A lock-latch set as claimed in claim 28 in which said movable member of the shaft assembly comprises a sleeve mounted for rotation around a longitudinal axis, said sleeve having a slot therein extending longitudinally thereof and forming spaced longitudinally-extending edges, said sleeve being so positioned relative to said ends of the slide members that when the sleeve is rotated in either direction around the longitudinal axis thereof, one of said edges engages said inner end portions of all of the slide members to move the locking trains in said opposite direction to disengage the stop means of the latch member to allow said member to rotate to the unlock position.

32. A lock-latch set as claimed in claim 31 in which said lugs are of different lengths thereby determining the lengths of their respecting trains, and including a limit bar mounted adjacent the ends of the locking arms having said lugs thereon, and a stop on the bar for each locking arm and normally positioned to stop the movement of said each arm when the lug thereof disengages the stop means.

33. A lock-latch set as claimed in claim 32 in which said limit bar is mounted for movement to shift the stops thereof out of their normal positions and clear of the locking arms, and including linkage means interconnecting said sleeve and said limit bar whereby rotation of the sleeve around the longitudinal axis thereof moves said linkage means to move the limit bar and thereby shift the stops out of their normal positions.

34. A lock-latch set as claimed in claim 31 in which said slide members are of different lengths thereby determining the lengths of their respective trains, and including a limit bar mounted adjacent the ends of the locking arms having said lugs thereon, and a stop on the bar for each locking arm and normally positioned to stop the movement of said each arm when the lug thereof disengages the stop means.

35. A lock-latch set as claimed in claim 34 in which said limit bar is mounted for movement to shift the stops thereof out of their normal positions and clear of the locking arms, and including linkage means interconnecting said sleeve and said limit bar whereby rotation of the sleeve around the longitudinal axis thereof moves said linkage means to move the limit bar and thereby shift the stops out of their normal positions.

36. A lock-latch set as claimed in claim 28 in which said shaft assembly comprises a shaft mounted for rotation around a longitudinal axis, and said means for receiving a key comprises a key slot in an extending longitudinally of the shaft and opening laterally out therefrom, said slot opening out from an outer end of the shaft, said key being insertable in and movable longitudinally of said slot with the key teeth projecting laterally from the shaft, said shaft being so positioned relative to said end portions of the slide members that when the shaft with the key therein is rotated around the longitudinal axis of the shaft, said key teeth engage said end portions of the slide members of their respective trains to move all of said trains in said opposite direction to disengage the stop means of the latch member to allow said member to rotate to the unlock position.

37. A lock-latch set as claimed in claim 28 in which said movable means of the shaft assembly comprises a sleeve mounted for rotation around a longitudinal axis, said sleeve having a slot therein extending longitudinally thereof and forming spaced longitudinally-extending edges, said sleeve being so positioned relative to said end portions of the slide members that when the sleeve is rotated in either direction around the longitudinal axis, one of said edges engages all of said slide member end portions to move the locking trains in said opposite direction, a shaft extending into the sleeve and mounted for rotation around the longitudinal axis of said sleeve independently of the sleeve, and said means for receiving a key comprises a key slot in and extending longitudinally of the shaft and opening laterally out therefrom towards said sleeve slot, said shaft slot opening out from an outer end of the shaft remote from the sleeve, said key being insertable in and movable longitudinally of the shaft slot with the key teeth projecting laterally from the shaft and out through the sleeve slot, said shaft being so positioned relative to said end portions of the slide members that when the shaft with the key therein is rotated around the longitudinal axis of the shaft, said key teeth engage said end portions of the slide members of their respective trains to move all of said trains in said opposite direction.

38. A lock-latch set as claimed in claim 37 including a slot in the end of the shaft in the sleeve, a key lug in the sleeve engageable with said end slot, and means normally biasing the sleeve to retain the key lug clear of the shaft end slot, said sleeve being longitudinally movable against said biasing means to bring the key lug into engagement with the end slot, whereby rotation of the shaft without a key in the slot thereof rotates the sleeve to move the locking trains thereby.

39. A lock-latch set as claimed in claim 37 including holding means for releasably retaining the sleeve in the position with the key lug thereof in engagement with the shaft end slot.

40. A lock-latch set as claimed in claim 37 including holding means operable, when the sleeve is rotated around its longitudinal axis to move the locking trains and then moved back again, to retain the sleeve in the position with the key lug thereof in engagement with the shaft end, said holding means releasing the sleeve when said sleeve is next rotated to move the locking trains to allow the biasing means to shift the sleeve longitudinally to disengage the key lug from the shaft end slot.

41. A lock-latch set as claimed in claim 37 comprising catch means selectively operable to one position to prevent movement of the locking trains in said opposite direction to disengage the stop means, or to another position to prevent movement of the trains in said one direction to engage the stop means, or to a further position to allow movement of the trains in both of said directions.

42. A lock-latch set as claimed in claim 37 in which said lugs are of different lengths thereby determining the lengths of their respecting trains, and including a limit bar mounted adjacent the ends of the locking arms having said lugs thereon, and a stop on the bar for each locking arm and normally positioned to stop the movement of said each arm when the lug thereof disengages the stop means.

43. A lock-latch set as claimed in claim 42 in which said limit bar is mounted for movement to shift the stops thereof out of their normal positions and clear of the locking arms, and including linkage means interconnecting said sleeve and said limit bar whereby rotation of the sleeve around the longitudinal axis thereof moves said linkage means to move the limit bar and thereby shift the stops out of their normal positions.

44. A lock-latch set as claimed in claim 37 in which said slide members are of different lengths thereby determining the lengths of their respective trains, and including a limit bar mounted adjacent the ends of the locking arms having said lugs thereon, and a stop on the bar for each locking arm and normally positioned to stop the movement of said each arm when the lug thereof disengages the stop means.

45. A lock-latch set as claimed in claim 44 in which said limit bar is mounted for movement to shift the stops thereof out of their normal positions and clear of the locking arms, and including linkage means interconnecting said sleeve and said limit bar whereby rotation of the sleeve around the longitudinal axis thereof moves said linkage means to move the limit bar and thereby shift the stops out of their normal positions.

46. A lock-latch set as claimed in claim 28 in which said lugs are of different lengths thereby determining the lengths of their respecting trains, and including a limit bar mounted adjacent the ends of the locking arms having said lugs thereon, and a stop on the bar for the locking arm of each train excepting each dummy train and normally positioned to stop movement of said locking arm when the lug thereof disengages the stop means.

47. A lock-latch set as claimed in claim 28 in which said slide members are of different lengths thereby determining the lengths of their respecting trains, and including a limit bar mounted adjacent the ends of the locking arms having said lugs thereon, and a stop on the bar for the locking arm of each train excepting each dummy train and normally positioned to stop movement of said locking arm when the lug thereof disengages the stop means.

48. A lock-latch set as claimed in claim 6 comprising second stop means on the latch member, and at least on dummy locking train similar to and normally movable with the first-mentioned locking trains; said dummy locking train comprising a locking arm, a lug on an outer end of the arm positioned normally to engage the first-mentioned stop means, and a finger connected to the inner end of said locking arm positioned normally clear of said second stop means and clear of the second stop means when the lugs of the first-mentioned trains clear the first-mentioned stop means during normal movement of the locking trains, said finger also being positioned to engage said second-mentioned stop means when said dummy train is shifted more than the normal movement thereof.

49. A lock-latch set as claimed in claim 48 in which said second stop means is the opposite side of the latch member from the first-mentioned stop means, the locking arm lug of each first-mentioned train extends towards said first-mentioned stop means, and the finger of each dummy train extends towards the second stop means and opposed to said lugs.

50. A lock-latch set as claimed in claim 28 comprising second stop means on the latch member, and at least on dummy locking train similar to and normally movable with the first-mentioned locking trains; said dummy locking train comprising a locking arm, a lug on an outer end of the arm positioned normally to engage the first-mentioned stop means, a finger on said locking arm positioned normally clear of said second stop means and clear of the second stop means when the lugs of the first-mentioned trains clear the first-mentioned stop means during normal movement of the locking trains, said finger also being positioned to engage said second-mentioned stop means when said dummy train is shifted more than the normal movement thereof.

51. A lock-latch set as claimed in claim 50 in which said second stop means is the opposite side of the latch member from the first-mentioned stop means, the locking arm lug of each first-mentioned train extends towards said first-mentioned stop means, and the finger of each dummy train extends towards the second stop means and opposed to said lugs.

* * * * *